US006930266B2

(12) United States Patent
Takeuchi et al.

(10) Patent No.: US 6,930,266 B2
(45) Date of Patent: Aug. 16, 2005

(54) PUSH-BUTTON SWITCH

(75) Inventors: Masatsugu Takeuchi, Tsuyama (JP); Hisashi Watanabe, Katsuta-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/994,422

(22) Filed: Nov. 22, 2004

(65) Prior Publication Data

US 2005/0126901 A1 Jun. 16, 2005

(30) Foreign Application Priority Data

Dec. 12, 2003 (JP) ..... 2003-414459

(51) Int. Cl.[7] ..... H01H 5/30; H01H 1/02
(52) U.S. Cl. ..... 200/406; 200/516; 200/269
(58) Field of Search ..... 200/406, 516, 200/262–270

(56) References Cited

U.S. PATENT DOCUMENTS 3,808,384 A * 4/1974 Boulanger ..... 200/5 A
4,254,309 A * 3/1981 Johnson ..... 200/5 A
4,263,485 A * 4/1981 Corwin ..... 200/5 A
5,986,228 A * 11/1999 Okamoto et al. ..... 200/516
6,271,487 B1 * 8/2001 Domzalski et al. ..... 200/1 B
6,492,602 B2 * 12/2002 Asai et al. ..... 200/1 B
6,639,159 B2 * 10/2003 Anzai ..... 200/1 B

FOREIGN PATENT DOCUMENTS

JP 2002-334628 11/2002

* cited by examiner

*Primary Examiner*—Michael A. Friedhofer
(74) *Attorney, Agent, or Firm*—RatnerPrestia

(57) ABSTRACT

A push-button switch includes insulating member having a surface, first and second stationary contacts electrically isolated from each other and provided at the surface of the insulating substrate, and a movable contact. The movable contact includes an elastic metal base having a dome-shape and having a concave surface spaced from the first stationary contact and an outer rim mounted on the second stationary contact, a nickel plated layer provided on the concave surface of the elastic metal base and having a thickness ranging from 0.05 μm to 0.5 μm, a copper plated layer provided on the nickel plated layer and having a thickness ranging from 0.05 μm to 0.7 μm, and a silver plated layer provided on the copper plated layer and having a thickness ranging from 0.1 μm to 2 μm. The push-button switch has a long operating life time, has a stable contact resistance, and is inexpensive.

6 Claims, 6 Drawing Sheets

PUSH-BUTTON SWITCH

FIELD OF THE INVENTION

The present invention relates to a push-button switch, which provides a click feel upon being pressed, for use in input units of electronic apparatuses.

BACKGROUND OF THE INVENTION

As electronic apparatuses have had small sizes, had a lot of functions, and be inexpensive, components included in the apparatuses are accordingly demanded to have small sizes, have long life time, and be inexpensive. Push-button switches of such components providing clear click feel upon operating are easily activated, hence being widely used in input units of the electronic apparatuses. The switches are accordingly demanded to have low, stable contact resistances and long operating life time.

A conventional push-button switch disclosed in Japanese Patent Laid-Open Publication No. 2002-334628 will be explained. FIG. 5 is a front cross sectional view of the conventional push-button switch. FIG. 6 is an exploded perspective view of the switch. A center stationary contact 2A and an outer stationary contact 3A provided by insert forming on the center and a periphery of a bottom of a case 1, respectively. The case 1 has a bottomed box-like shape and made of insulating resin material so that the contacts are electrically isolated from each other and have respective tops thereof. The center stationary contact 2A and an outer stationary contact 3A both made of metal material which have been firstly plated with nickel and then with silver. The center stationary contact 2A and the outer stationary contact 3A are connected to external terminals 2 and 3, respectively. A movable contact 4 made of stainless steel has a dome shape protruding upward.

The movable contact 4 includes a metal base, a nickel plated layer on the base, a palladium-nickel alloy plated layer on the nickel plated layer, and a gold-cobalt alloy plated layer on the palladium-nickel alloy plated layer. The plated layers face the stationary contact 2A. The movable contact 4 has an outer rim mounted on the outer stationary contact 3A in the case 1 while a center bottom 4A of the contact 4 is spaced by a predetermined distance from the center stationary contact 2A.

The center top of the movable contact 4 contacts a pressing portion 5A at a lowest part of a push button 5, an operation member, made of insulating resin. The push button 5 has an operating portion 5B at the upper part thereof projecting upward through a center opening 6A of a cover 6 for covering an upper opening of the case 1.

An operation of the conventional push-button switch will be explained.

When the operating portion 5*b* projecting upward through the center opening 6A of the cover 6 is pressed down, the push button 5 moves downward from a off-position shown in FIG. 5 and has the pressing portion 5A to apply a pressing force 5C to the top of the movable contact 4.

When the pressing force 5C exceeds a predetermined level, the top of the movable contact 4 is reversed to provide a click feel, and has the center bottom 4A contact the center stationary contact 2A in case 1. Then, the center stationary contact 2A is connected to the outer stationary contact 3A through the movable contact 4, thus having the push-button switch turned on.

Then, when the pressing force to the operating portion 5B of the push button 5 is released, the push-button switch is turned back to a off-position shown in FIG. 5 with an self-recovering action of the movable contact 4.

Electric signals corresponding to turning on and off of the switch are transmitted to a circuit in an electric apparatus (not shown) via the terminals 2 and 3 connected to the stationary contacts 2A and 3A, respectively.

In the conventional push-button switch, the lower surface of the movable contact 4 arranged to contact the stationary contacts 2A and 3A is coated with the nickel plated layer, the palladium-nickel alloy plated layer, and the gold-cobalt alloy plated layer in order to increase its operating life time and decrease a contact resistance Plating materials, such as palladium and gold, are expensive rare metals, thus preventing the push-button switch from being inexpensive.

SUMMARY OF THE INVENTION

A push-button switch includes insulating member having a surface, first and second stationary contacts electrically isolated from each other and provided at the surface of the insulating substrate, and a movable contact. The movable contact includes an elastic metal base having a dome-shape and having a concave surface spaced from the first stationary contact and an outer rim mounted on the second stationary contact, a nickel plated layer provided on the concave surface of the elastic metal base and having a thickness ranging from 0.05 $\mu$m to 0.5 $\mu$m, a copper plated layer provided on the nickel plated layer and having a thickness ranging from 0.05 $\mu$m to 0.7 $\mu$m, and a silver plated layer provided on the copper plated layer and having a thickness ranging from 0.1 $\mu$m to 2 $\mu$m.

The push-button switch has a long operating life time, has a stable contact resistance, and is inexpensive.

DETAILED DESCRIPTION OF THE PREFERRED EMBODIMENT

Figure 1:
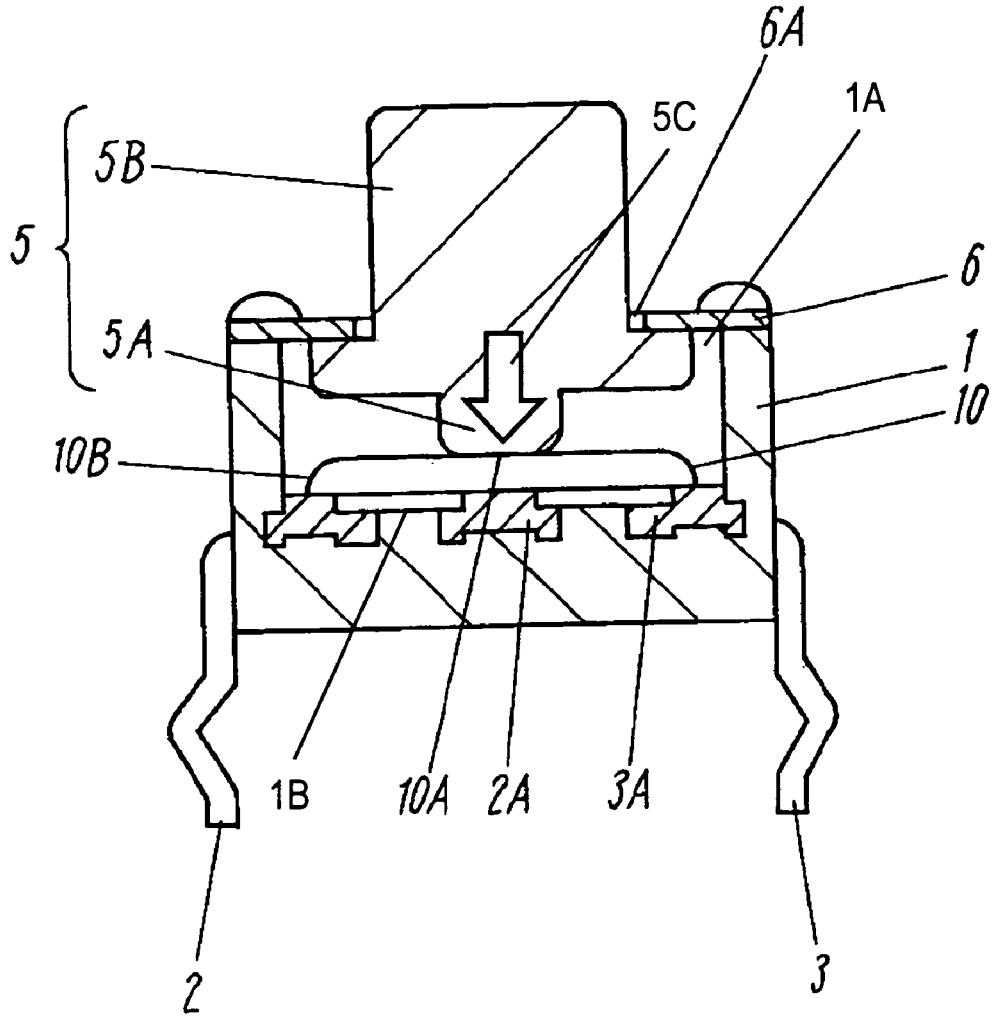
FIG. 1 is a front cross sectional view of a push-button switch according to an exemplary embodiment of the present invention.
Figure 2:
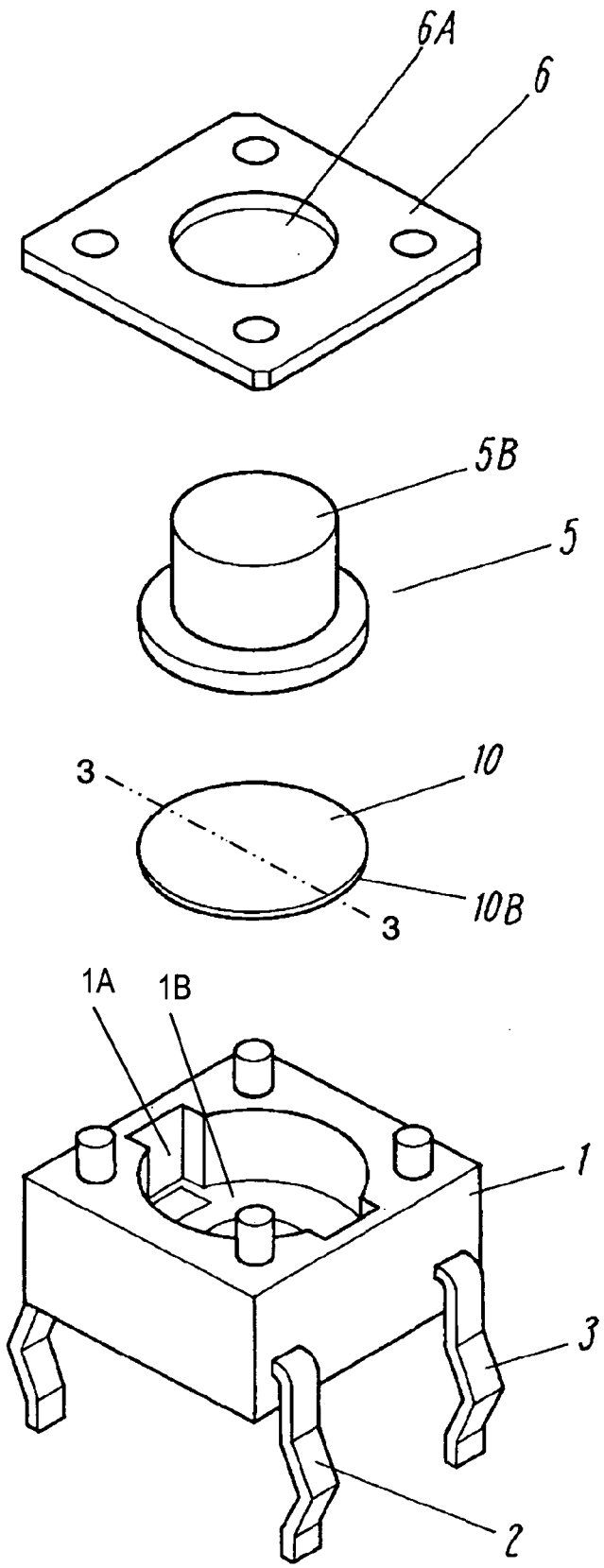
FIG. 2 is an exploded perspective view of the push-button switch according to the embodiment.
Figure 5:
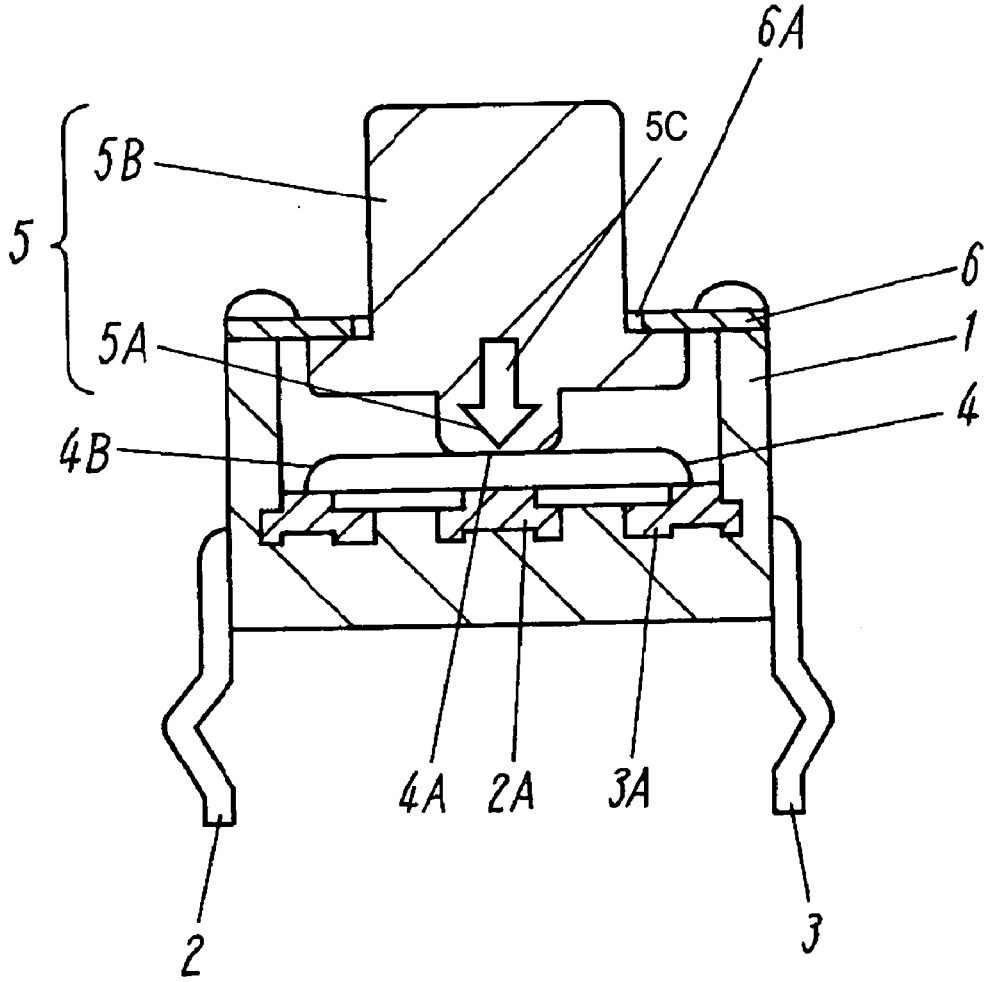
FIG. 5 is a front cross sectional view of a conventional push-button switch.
Figure 6:
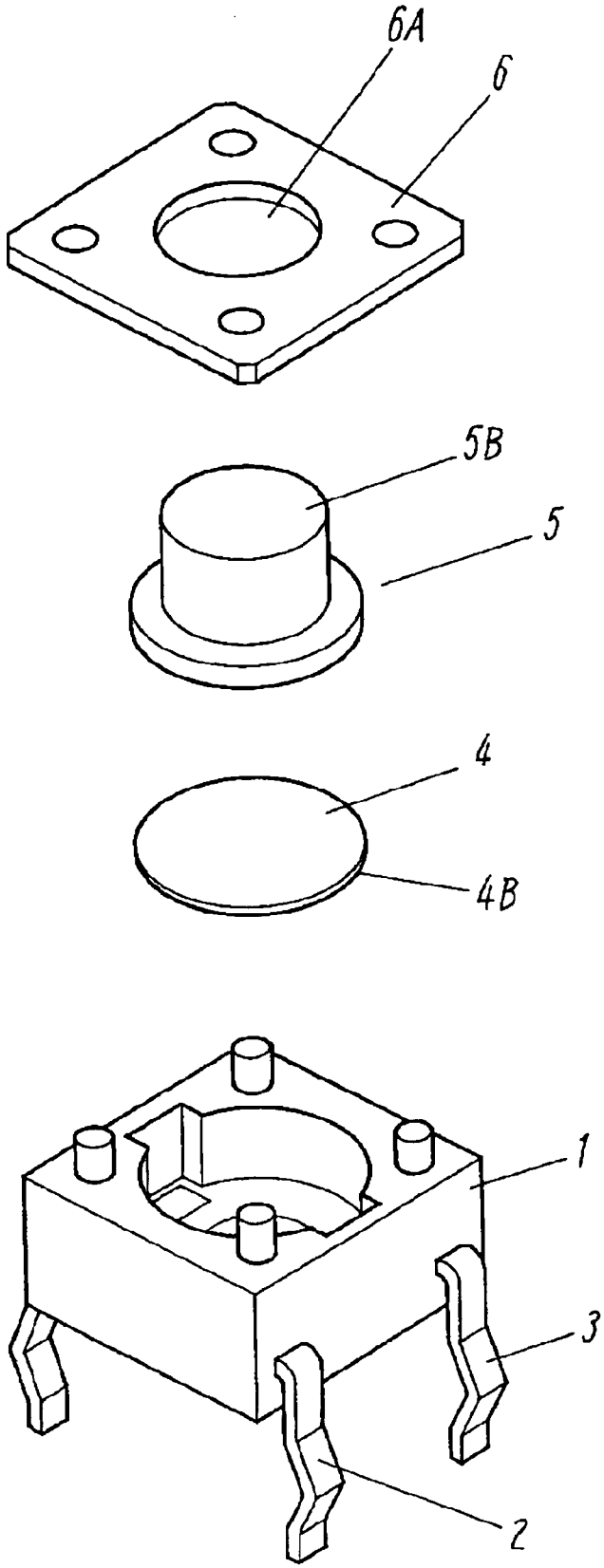
FIG. 6 is an exploded perspective view of the conventional push-button switch.

FIG. 1 is a front cross sectional view of a push-button switch according to an exemplary embodiment of the present invention. FIG. 2 is an exploded perspective view of the push-button switch. The same components as those of the conventional push-button switch shown in FIGS. 5 and 6 are denoted by the same reference numerals and will be explained in no more detail.

A center stationary contact 2A and an outer stationary contact 3A are provided on an upper surface 1B of a bottom of a case 1. The case 1, an insulating member, has a bottomed box shape and is made of insulating resin material. The stationary contacts 2A and 3A are electrically isolated from each other. The center stationary contact 2A and the outer stationary contact 3A extend to an outside of the case 1 and are connected to external connecting terminals 2 and 3, respectively. A movable contact 10 made of stainless steel has a dome shape protruding at its center is accommodated in an opening 1A of the case 1. The movable contact 10 has an outer edge 10B on the outer stationary contact 3A while having a concave surface 10A at its center is spaced by a predetermined distance from the center stationary contact 2A. The movable contact 10 has a convex surface 10H contacting a pressing portion 5A at the lower part of a push button 5 made of insulating resin. An operating portion 5B at the upper part of the push button 5 projects upwardly through a center opening 6A of a cover 6 for covering the opening 1A of the case 1. Each of the center stationary contact 2A and the outer stationary contact 3A includes a metal base, a nickel plated layer on the base, and a silver plated layer on the nickel plated layer.

Figure 3:
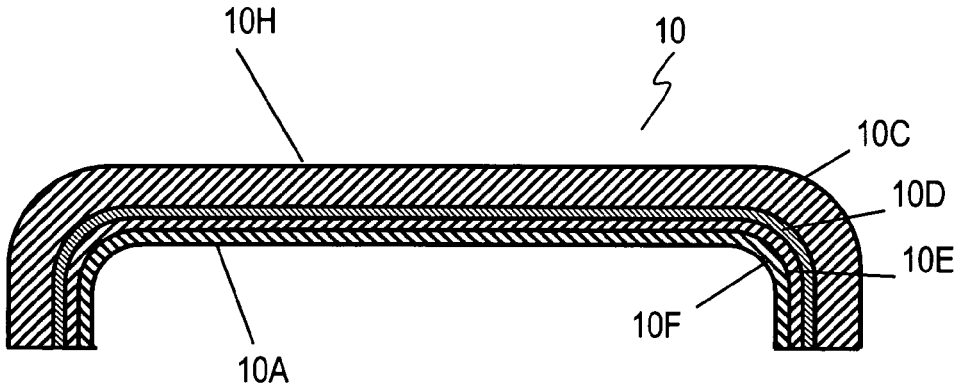
FIG. 3 is a cross sectional view of a movable contact of the push-button switch according to the embodiment.

FIG. 3 is a cross sectional view of the movable contact 10 shown in FIG. 2 taken along the line 3—3 of FIG. 2. The movable contact 10 includes an elastic metal base 10C, a nickel plated layer 10D on the metal base 10C, a copper plated layer 10E on the nickel plated layer 10D, and a silver plated layer 10F on the copper plated layer 10E. The plated layers 10D, 10E, and 10F are provided at the concave surface 10A of the movable contact 10 which faces the center stationary contact 2A. The metal base 10C of the movable contact 10 may be made of stainless steel, such as EH steel of SUS301.

An operation of the push-button switch of the embodiment will be explained.

When the operating portion 5B projecting upward through the center aperture 6A of the cover 6 is pressed down, the push button 5 moves downward from an off-position shown in FIG. 1 and has the pressing portion 5A apply a pressing force 5C to the top 10H at the center of the movable contact 10.

Upon the pressing force 5C exceeding a predetermined level, the dome shape of the movable contact 10 is reversed to provide a click feel, and the concave surface 10A contacts the center stationary contact 2A in case 1. Then, the center stationary contact 2A is connected to the outer stationary contact 3A through the movable contact 10, thus turning on the push-button switch.

Then, when the pressing force to the operating portion 5B of the push button 5 is released, the push-button switch is turned back to the off-position shown in FIG. 1 by a self-recovering action of the movable contact 10.

Electric signals corresponding to turning on and off of the switch are transmitted to a circuit in an electric apparatus (not shown) via the terminals 2 and 3 connected to the stationary contacts 2A and 3A, respectively.

Samples of the push-button switch including the plated layers 10D, 10E, and 10F of the movable contact 10 having various thicknesses were prepared. In the samples, the thickness of the nickel plated layer 10D ranges from 0.05 μm to 0.5 μm, the thickness of the copper plated layer 10E ranges from 0.05 μm to 0.7 μm, and the thickness of the silver plated layer 10F ranges from 0.1 μm to 2 μm.

In sample 1, the nickel plated layer 10D had a thickness of 0.05 μm, the copper plated layer 10E had a thickness of 0.05 μm, and the silver plated layer 10F had a thickness of 0.1 μm. In sample 2, the nickel plated layer 10D had a thickness of 0.3 μm, the copper plated layer 10E had a thickness of 0.4 μm, and the silver plated layer 10F had a thickness of 1 μm. In sample 3, the nickel plated layer 10D had a thickness of 0.5 μm, the copper plated layer 10E had a thickness of 0.7 μm, and the silver plated layer 10F had a thickness of 2 μm. A comparative sample corresponded to a conventional push-button switch shown in FIG. 5 and had a nickel plated layer having a thickness of 0.2 μm, a palladium-nickel alloy plated layer having a thickness of 0.4 μm, and a gold-cobalt alloy plated layer having a thickness of 0.4 μm. The movable contacts 10 of Samples 1 to 3 and the movable contact 4 of the comparative sample were made of EH stainless steel of SUS301.

Samples 1 to 3 and the comparative sample of push-button switches were pushed repetitively twice per second at a pressing force of 1.5N under a no-load condition, and had their contact resistances during the pushing were measured. More particularly, samples 1 to 3 and the comparative sample were measured respectively in their contact resistances between their stationary contacts and their movable contacts after zero times, 100 thousand times, 300 thousand times, 500 thousand times, 700 thousand times, and one million times of the pushing operation.

Figure 4:
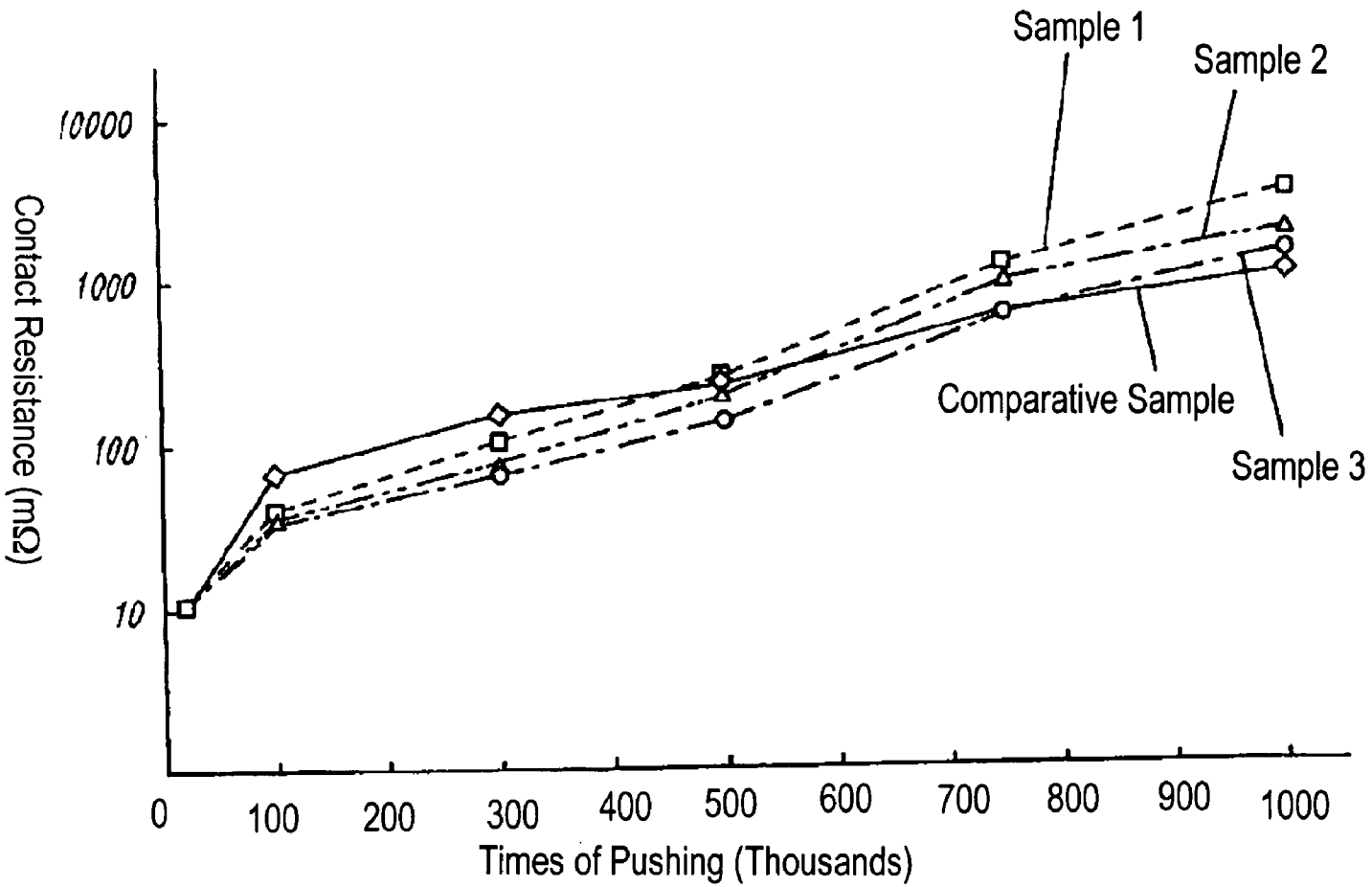
FIG. 4 illustrates a change in a contact resistance and a number of operating time of the push-button switch according to the embodiment.

FIG. 4 illustrates changes of the contact resistances relating to the number of the pushing operation for samples 1 to 3 and the comparative sample. The contact resistance of the comparative sample of the push-button switch exceeds 1000 mΩ after about one million times of the pushing operation. The contact resistances of samples 1 and 2 exceed 1000 mΩ after about 750 thousand times of the pushing operation. The contact resistances of sample 3 exceed 1000 mΩ after about 750 thousand times to one million times of the pushing operation.

The contact resistances of sample 1 to 3 are slightly smaller than that of the comparative sample before 500 thousand times of the pushing operation, and exhibit a slightly-sharper slope in a graph indicating an increase of each resistance than the contact resistance of the comparative sample within a range from 500 thousand times to 750 thousand times of the pushing operation.

It is estimated that the difference of the slope is provided due to the fact that palladium in the palladium-nickel alloy plated layer of the comparative is hard and increases a resistance to frictional wear.

However, samples 1 to 3, similarly to the comparative sample, have stable, large resistances at a great number, such as one million times, of the pushing operation. Thus samples 1 to 3 sufficiently satisfy a strict requirement that the contact resistance does not exceed 1000 mΩ after 300 thousand times of the pushing operation.

The increase of the contact resistances of samples 1 to 3 may be suppressed upon the plated layers 10D, 10E, and 10F being thick. In order to make the dome shape of the movable contact 10 easily and reducing cost of the plated layers, the contact including the nickel plated layer 10D having the thickness ranging from 0.05 μm to 0.5 μm, the copper plated layer 10E having the thickness ranging from 0.05 μm to 0.7 μm, and the silver plated layer 10F having the thickness ranging from 0.1 μm to 2 μm is manufactured easily.

What is claimed is:

1. A push-button switch comprising:

an insulating member having a surface;

first and second stationary contacts electrically isolated from each other and provided at the surface of the insulating substrate; and a movable contact including an elastic metal base having a dome-shape and having a concave surface spaced from the first stationary contact and an outer rim mounted on the second stationary contact, a nickel plated layer provided on the concave surface of the elastic metal base and having a thickness ranging from 0.05 μm to 0.5 μm, a copper plated layer provided on the nickel plated layer and having a thickness ranging from 0.05 μm to 0.7 μm, and a silver plated layer provided on the copper plated layer and having a thickness ranging from 0.1 μm to 2 μm.

2. The push-button switch according to claim 1, wherein the elastic metal base comprises stainless steel.

3. The push-button switch according to claim 1, wherein the insulating member has an opening having a bottom corresponding to the surface of the insulating member.

4. The push-button switch according to claim 1, wherein the movable contact has a convex surface opposite to the concave surface, said push-button switch further comprising an operation member provided on the convex surface of the movable contact.

5. The push-button switch according to claim 1, wherein the first stationary contact is plated with silver.

6. The push-button switch according to claim 1, wherein the second stationary contact is plated with silver.

* * * * *